US008599530B2

(12) United States Patent
Onda et al.

(10) Patent No.: US 8,599,530 B2
(45) Date of Patent: Dec. 3, 2013

(54) ELECTROMAGNETIC VALVE DRIVING CIRCUIT

(75) Inventors: Kohei Onda, Hitachi (JP); Ayumu Hatanaka, Tokai (JP); Akira Mishima, Mito (JP); Takuya Mayuzumi, Hitachinaka (JP); Fumiaki Nasu, Hitachinaka (JP); Mitsuhiko Watanabe, Odawara (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 226 days.

(21) Appl. No.: 13/034,757

(22) Filed: Feb. 25, 2011

(65) Prior Publication Data

US 2011/0222202 A1 Sep. 15, 2011

(30) Foreign Application Priority Data

Mar. 9, 2010 (JP) ..... 2010-051565

(51) Int. Cl.
*H01H 47/22* (2006.01)

(52) U.S. Cl.
USPC ..... 361/152

(58) Field of Classification Search
USPC ..... 361/156, 152; 123/490
See application file for complete search history.

(56) References Cited

U.S. PATENT DOCUMENTS 5,975,057 A * 11/1999 Repplinger et al. ..... 123/490
6,657,845 B2 * 12/2003 Kanomata et al. ..... 361/159
6,721,158 B2 4/2004 Heinke
7,578,284 B2 8/2009 Mayuzumi et al.
8,212,389 B2 * 7/2012 Morimoto ..... 307/30
2002/0179059 A1 12/2002 Aoki et al.

FOREIGN PATENT DOCUMENTS

CN 101230808 A 7/2008
DE 199 63 154 A1 6/2001
EP 1 179 670 A1 2/2002
EP 1 944 492 A2 7/2008
EP 1944492 A2 * 7/2008

(Continued)

OTHER PUBLICATIONS

European Search Report dated Aug. 3, 2012 (six (6) pages).

(Continued)

*Primary Examiner* — Rexford Barnie
*Assistant Examiner* — Joseph Inge
(74) *Attorney, Agent, or Firm* — Crowell & Moring LLP

(57) ABSTRACT

Disclosed is an electromagnetic valve driving circuit capable of reducing a load of a booster circuit. A boost driving FET 202 is connected to a route formed between the booster circuit 100 and a first terminal of an injector 3. A battery-side driving FET 212 and a battery protection diode Db are connected to a route formed between a positive-polarity side of a power supply and the first terminal of the injector 3. A freewheeling diode Df is connected at a first terminal thereof to a portion between the first terminal of the injector 3 and the battery protection diode Db, and at a second terminal thereof to a grounding side of the power supply. An injector downstream-side driving FET 220 is connected to a route formed between the second terminal of the injector 3 and the grounding side of the power supply. In addition to operating the FETs 202, 212, and 220 according to a level of a current which flows through the injector 3, a control circuit 240 activates the battery-side driving FET 212 during a period in which the boost driving FET 202 repeatedly turns on and off a plurality of times.

6 Claims, 5 Drawing Sheets

(56) References Cited

FOREIGN PATENT DOCUMENTS

| | | | |
|---|---|---|---|
| JP | 2002-364768 | A | 12/2002 |
| JP | 2008-169762 | A | 7/2008 |
| JP | 2009-243275 | A | 10/2009 |
| JP | 2010-106847 | A | 5/2010 |
| JP | 2010-229877 | A | 10/2010 |

OTHER PUBLICATIONS

Japanese Office Action with English Translation dated Feb. 7, 2012, (eight (8) pages).

Chinese Office Action with English Translation dated May 6, 2013 (eight (8) pages).

* cited by examiner

ELECTROMAGNETIC VALVE DRIVING CIRCUIT

BACKGROUND OF THE INVENTION

1. Field of the Invention

The present invention relates generally to electromagnetic valve driving circuits that drive electromagnetic valves using a high voltage obtained by boosting a supply voltage. More particularly, the invention concerns an electromagnetic valve driving circuit suitable for driving a fuel injector of a direct in-cylinder injection type.

2. Description of the Related Art

Traditionally, in order to improve fuel efficiency and engine power, the automobiles, motorcycles, agricultural tractors, machine tools, and marine engines which are fueled by gasoline, a light oil, or the like, each use an internal-combustion engine controller equipped with an injector that directly injects the fuel into cylinders. Such an injector is called the direct in-cylinder fuel injector or simply the direct injector (DI).

Currently, the scheme for injecting a fuel into an air intake pipe is mainly employed in gasoline engines. Engines equipped with the direct in-cylinder fuel injector that uses the fuel boosted to a high pressure, however, need energy higher than that required for the engines of the above scheme, to open a valve of the injector. In addition, to improve controllability for high-speed rotation, high energy needs to be supplied to the injector. Furthermore, although the technology of multistage injection for saving the fuel and reducing exhaust gas emissions is catching attention in connection with the engines having the direct in-cylinder fuel injector, this technology involves injecting the fuel in several split operations for one piston action, instead of injecting the fuel in one operation in conventional technology, and thus requires supplying high energy to the injector within an even shorter time.

In general, many types of injector driving circuits for controlling the direct in-cylinder fuel injector include a booster circuit that boosts a battery voltage to a higher voltage, and apply the high voltage generated by this booster circuit to reduce an operational response time of the injector. In the multistage injection technology that involves more frequent injector operation than the conventional technology, therefore, the booster circuit increases in load, so it is a critical challenge how to reduce the load of the booster circuit.

A typical current signal waveform of the direct injector is described below. First, during an initial peak-current conduction period of current application, the injector current is boosted to a predetermined peak level by using a boost voltage to open a valve of the injector. This peak current is about 5 to 20 times as great as the injector current developed in the prevailing gasoline engine scheme for injecting a fuel into an air intake pipe. After the conduction period of the peak current, the source of energy supply to the injector changes from the booster circuit to a battery power supply, and thus a valve-opening hold current lower than the peak current level is supplied to hold the open state of the injector valve. When the peak current and the valve-opening hold current are supplied, the injector with the open valve injects the fuel into cylinders.

After the injection, there is a need to cut off the injector current by reducing a level of the injector supply current within a short time to rapidly close the injector valve. However, since the injector current is flowing through the injector and high energy is stored therein, this energy needs to be made to disappear from the injector. In order to implement this within a short time, various schemes are adopted. These schemes include, for example, a scheme that converts the energy into thermal energy by utilizing a Zener diode effect created by a driving element of a circuit which drives the injector current, and a scheme that makes the injector current flow back via a current regeneration diode by providing a boost capacitor having the booster circuit's boost voltage stored therein.

In terms of improving independent characteristics of the injector or combustion characteristics of the fuel in the engine, the injector may preferably hold the peak current for a certain period of time in some cases. The hold of this peak current can be achieved by repeating on/off operations on a switching element connected between the injector and the booster circuit during a short period of time, that is, by intermittently applying the boost voltage to the injector and repeatedly increasing/reducing a slight current. A method likely to be useable to reduce the injector current at this time is by adopting a freewheeling scheme in which the injector current is to be reduced in level by returning the current to a route that passes through a freewheeling diode, or a regenerative scheme in which, as described above, the boost capacitor having the booster circuit's boost voltage stored therein regenerates the injector current during the foregoing valve-closing operation. JP-2008-169762-A, for example, discloses a driving method that uses the freewheeling scheme to hold a peak current of an injector.

SUMMARY OF THE INVENTION

However, when the boost voltage is intermittently applied to the injector and the peak current is held for a certain period, a shorter reduction time of the current during the hold period causes more frequent application of the boost voltage for increased current, thus increasing the load of the booster circuit. In particular, in the multistage injection technology where the booster circuit increases in load, it is even more important to reduce the booster circuit load.

An object of the present invention is to provide an electromagnetic valve driving circuit capable of reducing a load of a booster circuit.

In order to solve the above problem, one of desirable aspects of the present invention is as follows:

The electromagnetic valve driving circuit includes: a booster circuit for generating a high voltage from a power supply; a first switching element connected to a route formed between the booster circuit and a first terminal of the electromagnetic valve; a second switching element connected to a positive-polarity side of the power supply; a first diode connected to a route connected between a negative-polarity side of the second switching element and the first terminal of the electromagnetic valve; a second diode connected at a first terminal thereof to a portion between the first terminal of the electromagnetic valve and the first diode, and at a second terminal thereof to a grounding side of the power supply; a third switching element connected to a route formed between a second terminal of the electromagnetic valve and the grounding side of the power supply; and control means for operating appropriately the first switching element, the second switching element, and the third switching element, according to a level of a current which flows through the electromagnetic valve; wherein the control means includes peak-hold assist means to activate the second switching element during a time period in which the first switching element repeats on/off switching control a plurality of times.

According to the present invention, the booster circuit can be reduced in load.

DESCRIPTION OF THE PREFERRED EMBODIMENTS

Hereunder, composition and operation of an electromagnetic valve driving circuit according to a first embodiment of the present invention will be described using FIGS. 1 to 3.

First, a configuration of an electromagnetic valve control system using the electromagnetic valve driving circuit according to the present embodiment is described below using FIG. 1.

Figure 1:
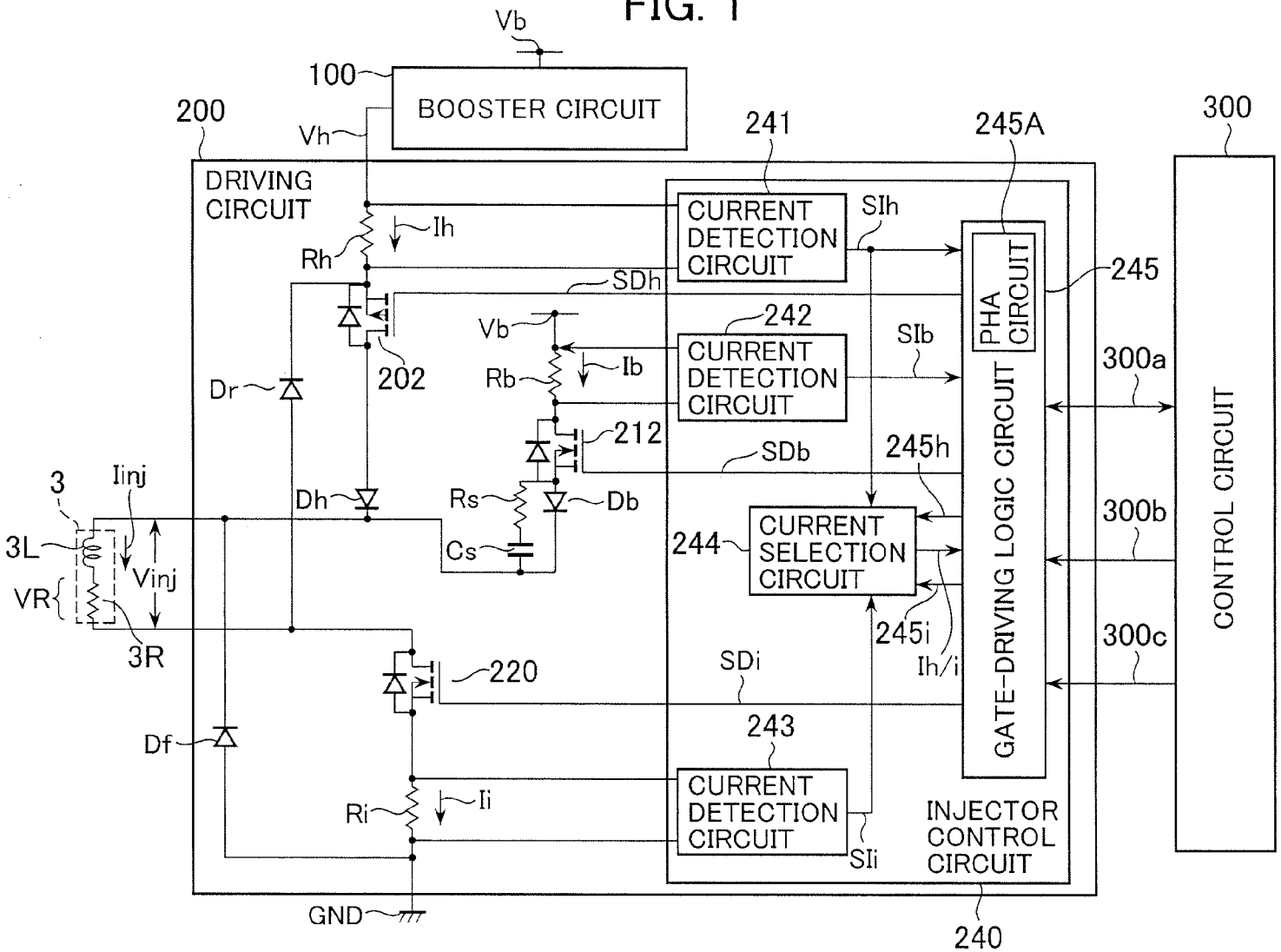
FIG. 1 is a circuit block diagram that shows a configuration of an electromagnetic valve control system using an electromagnetic valve driving circuit according to a first embodiment of the present invention.

FIG. 1 is a circuit block diagram that shows the configuration of the electromagnetic valve control system using the electromagnetic valve driving circuit according to the first embodiment of the present invention.

While a direct in-cylinder injection type of fuel injector is described and shown as an example of an electromagnetic valve in FIG. 1, the present invention can also be applied to other electromagnetic valves that use a booster circuit. In addition, while the driving circuit shown in FIG. 1 drives one injector, this driving circuit can drive a plurality of injectors.

The electromagnetic valve driving circuit according to the present embodiment includes a booster circuit 100 and a driving circuit 200. The driving circuit 200 controls supply of a current to the injector 3 in accordance with a control command from a control circuit 300. The control circuit 300, consisting of an engine control unit and other elements, controls the supply of the current to the injector 3 according to a particular state of a motor vehicle and/or intent of a driver. The injector 3 is a fuel injector of the direct injection type. Either a high voltage Vh that the booster circuit 100 has generated by boosting an original voltage, or a voltage Vb from a battery is applied to the injector 3.

The injector 3 can be represented as an equivalent circuit composed of a series-connected internal coil 3L and internal parasitic resistor 3R. In general, fuel injectors of the direct in-cylinder injection type are as low as about several ohms in parasitic resistance value.

The booster circuit 100 is shared by a plurality of driving circuits 200. One to four booster circuits 100 are usually mounted for one engine. The number of driving circuits 200 which share the booster circuit 100 is determined by several factors. These factors include: a boost recovery period determined by a magnitude of energy needed to drive the injector during a peak current conduction period (expressed as P1 in FIG. 2) and peak current hold period (expressed as P2 in FIG. 2) of an injector current Iinj described later herein, a maximum engine speed, the number of multistage fuel injection cycles for one combustion cycle in one cylinder, and/or the like; the amount of heat which the booster circuit 100 generates in itself; and so on.

The booster circuit 100 increases the supply voltage Vb of the battery to the boost voltage Vh. If the battery voltage Vh is 12 V, for example, the boost voltage Vh is nearly 65 V, for example.

The boost voltage Vh that is the high voltage generated by the booster circuit 100 is supplied to an upstream side of the injector 3 via a boost current detection resistor Rh, a boost driving FET 202, and a boost protection diode Dh. The boost current detection resistor Rh converts into a voltage either an overcurrent component of a current which might flow out from the booster circuit 100, or a boost driving current Rha for detecting harness disconnections at the injector 3 side. The boost driving FET 202 drives the injector during the peak current conduction period P1 and peak current hold period P2 of the injector current Iinj described later herein. The boost protection diode Dh prevents an inverse current from occurring even if a booster circuit 100 failure occurs.

The supply voltage Vb from the battery is also supplied to the upstream side of the injector 3 via a battery-side current detection resistor Rb, a battery-side driving FET 212, and a battery protection diode Db. The battery-side current detection resistor Rb converts a battery-side driving current Rba into a voltage in order to detect either an overcurrent that might flow in from the battery power supply, or harness disconnections at the injector 3 side. The battery protection diode Db is provided to prevent a booster current from flowing back into the battery power supply. In addition, a snubber circuit composed of a series-connected resistor Rs and capacitor Cs is connected in parallel to the battery protection diode Db. Operation of the snubber circuit will be described later herein.

The battery-side driving FET 212 generally drives the injector in order to supply an open-valve state hold current thereto during an open-valve state hold current conduction period (period P4 described later herein). In the present embodiment, however, the FET 212 is also used to suppress a drop of the current during the peak current conduction period P1, as will be described later.

An injector downstream-side driving FET 220 is connected to a downstream side of the injector 3. On/off operation of the injector downstream-side driving FET 220 dictates an electrically energized/de-energized state of the injector 3. In the example of FIG. 1, the injector current Iinj that flows into the injector 3 reaches a grounding (GND) side of the power supply via a downstream-side current detection resistor Ri connected to a source electrode of the injector downstream-side driving FET 220.

Also, a freewheeling diode Df is connected between the GND side of the power supply and the upstream side of the injector 3. During the conduction period of the injector current Iinj, energizing the injector downstream-side driving FET 220 by electrically disconnecting both the boost driving FET 202 and the battery-side driving FET 212 at the same time causes a regenerative current in the injector. The freewheeling diode Df is provided to make this regenerative current continue to flow. For this reason, the freewheeling diode Df has an anode connected to the GND side of the power supply and a cathode connected to the upstream side of the injector 3.

In addition, a current regeneration diode Dr is provided between the downstream side of the injector 3 and a route of the boost voltage. In the example of FIG. 1, the current regeneration diode Dr has an anode connected to a route formed between the injector 3 and the downstream-side driving FET 220, and a cathode connected to a route formed between the boost current detection resistor Rh and the boost driving FET 202. The current regeneration diode Dr is used to de-energize all of the boost driving FET 202, the battery-side driving FET 212, and the injector downstream-side driving FET 220, during the conduction period of the injector current Iinj. Thus, electrical energy of the injector 3 is bypassed to flow into the booster circuit 100. Injector current bypassing is conducted to rapidly drop the injector supply current, mainly during valve closing of the injector.

The boost driving FET 202, the battery-side driving FET 212, and the injector downstream-side driving FET 220 have respective driving elements controlled by an injector valve-opening signal 300*b* and injector driving signal 300*c* which are generated by a control circuit 300 in accordance with an engine speed and sensor input parameter settings. The injector valve-opening signal 300*b* and the injector driving signal 300*c* are input to a gate-driving logic circuit 245 of an injector control circuit 240 within the particular driving circuit 200. Between the control circuit 300 and the gate-driving logic circuit 245, necessary information is updated in accordance with a communication signal 300*a*. A more specific example of the necessary information will be described later herein.

The injector control circuit 240 includes a boost current detection circuit 241, a battery-side current detection circuit 242, a downstream-side current detection circuit 243, and a current selection circuit 244, in addition to the gate-driving logic circuit 245. The boost current detection circuit 241 detects a boost driving current Ih that flows through the boost current detection resistor Rh. The battery-side current detection circuit 242 detects a battery-side driving current Ib that flows through the battery-side current detection resistor Rb. The downstream-side current detection circuit 243 detects a downstream-side driving current Ii that flows through the downstream-side current detection resistor Ri. The current selection circuit 244 selects the current that has been detected by either the boost current detection circuit 241 or the downstream-side current detection circuit 243. The current selection circuit 244, upon receiving a boost current selection signal 245*h* from the gate-driving logic circuit 245, selects the current detected by the boost current detection circuit 241, or upon receiving an injector downstream-side current selection signal 245*i* from the gate-driving logic circuit 245, selects the current detected by the current detection circuit 243, and then outputs a selection signal Ih/i.

The gate-driving logic circuit 245 generates a boost driving FET control signal SDh, a battery-side driving FET control signal SDb, or an injector downstream-side driving FET control signal SDi, depending upon a level of the current detected by the boost current detection circuit 241, the battery-side current detection circuit 242, or the downstream-side current detection circuit 243, that is, depending upon a boost current detection signal SIh, a battery-side current detection signal SIb, or an injector downstream-side current detection signal SIi. In addition, in accordance with the communication signal 300*a* developed between the driving circuit 200 and the control circuit 300, the control circuit 300 and the injector control circuit 240 exchange necessary information with each other and implement appropriate injector driving. The necessary information here refers to at least one of the following kinds of information: currents that determine an injector driving signal waveform, namely, a peak hold upper-limit current (current Ip2 described later in FIG. 2), a peak hold lower-limit current (current Ip1 described later in FIG. 2), an open-valve state hold upper-limit current (current If2 described later in FIG. 2), an open-valve state hold lower-limit current (current If1 described later in FIG. 2), a peak current hold period P2, and an open-valve state hold current conduction period P4; presence/absence of a peak current; whether the peak current is to be held; abrupt/gentle peak-current drop switching; abrupt/gentle peak-current trailing edge switching; abrupt/gentle supply current drop switching; whether a valve opening current is to be held; overcurrent detection results; disconnections detection results; overheating protection; booster circuit failure diagnostic results; and control signals of the injector control circuit 240 itself. The gate-driving logic circuit 245 includes a peak-hold assist (PHA) circuit 245A, which will be described later herein.

As disclosed in Patent Document 1, each current detection resistor can vary in connecting position. Composition of each current detection circuit and that of the current selection circuit also vary correspondingly. However, the present embodiment can be applied to these different forms of layout as well.

Next, the operation of the electromagnetic valve control system using the electromagnetic valve driving circuit according to the present embodiment is described below using FIG. 2.

Figure 2:
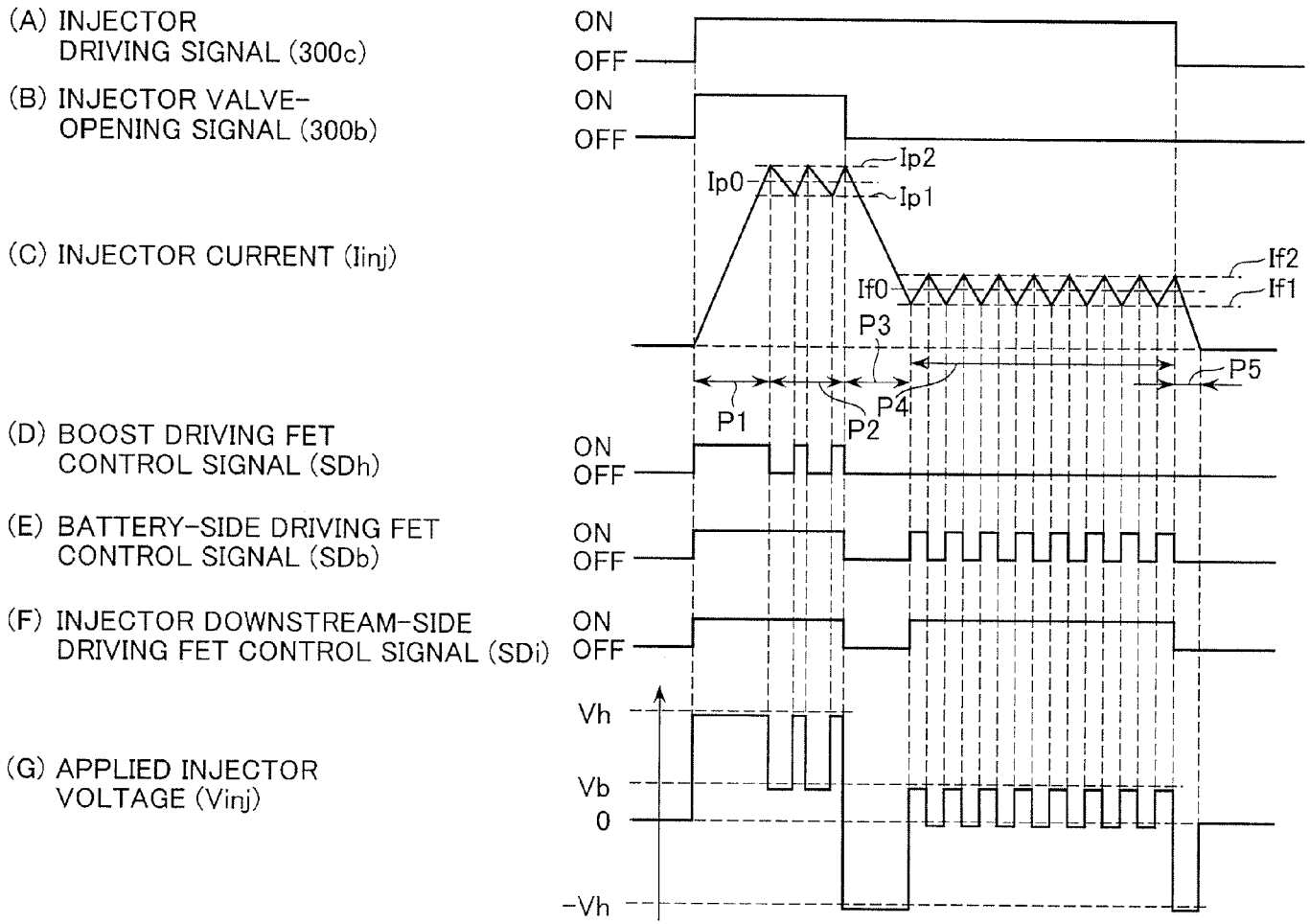
FIG. 2 is a timing chart that illustrates operation of the electromagnetic valve control system using the electromagnetic valve driving circuit according to the first embodiment of the present invention.

FIG. 2 is a timing chart that illustrates the operation of the electromagnetic valve control system using the electromagnetic valve driving circuit according to the first embodiment of the present invention.

Referring to FIG. 2, a horizontal axis denotes time. A vertical axis for item (A) of FIG. 2 denotes the injector driving signal 300*c*, a vertical axis for item (B) of FIG. 2 denotes the injector valve-opening signal 300*b*, and a vertical axis for item (C) of FIG. 2 denotes a signal waveform of the injector current Iinj. A vertical axis for item (D) of FIG. 2 denotes the boost driving FET control signal SDh, a vertical axis for item (E) of FIG. 2 denotes the battery-side driving FET control signal SDb, a vertical axis for item (F) of FIG. 2 denotes the injector downstream-side driving FET control signal SDi, and a vertical axis for item (G) of FIG. 2 denotes a voltage Vinj applied to the injector.

The signal waveform of the injector current Iinj, shown as item (C) in FIG. 2, can be divided into five periods: the peak current conduction period P1, the peak current hold period P2, an open-valve state hold current transition period P3, the open-valve state hold current conduction period P4, and a supply current reduction period P5.

First, when the injector driving signal 300*c* turns on as denoted by item (A) in FIG. 2 and the injector valve-opening signal 300*b* turns on as denoted by item (B) in FIG. 2, the peak current conduction period P1 starts, in which period, the boost voltage Vh from the booster circuit 100 rapidly steps up the injector current Iinj to a predetermined peak-hold upper-limit current Ip2. At this time, as denoted by items (D) and (F) in FIG. 2, the gate-driving logic circuit 245 outputs the boost driving FET control signal SDh and the injector downstream-side driving FET control signal SDi, respectively, and thus activates both the boost driving FET 202 and the injector downstream-side driving FET 220. This raises the applied injector voltage Vinj to the boost voltage Vh, as denoted by item (G) in FIG. 2, and abruptly changes the injector current Iinj from zero to the peak-hold upper-limit current Ip2. Actual boost voltage Vh is reduced by about 1 [V] in the diode Dh. During the peak current conduction period P1, operation is not affected, irrespective of whether the battery-side driving FET control signal SDb is on or off, but item (E) in FIG. 2 shows the 'on' state of the signal SDb by way of example.

During the period P1, the injector downstream-side current selection signal 245*i* is controlled to be on, and the boost current selection signal 245*h* is controlled to be off. This makes the current selection circuit 244 select the injector downstream-side current detection signal SIi that is output from the current detection circuit 243. Therefore, the injector downstream-side current detection signal SIi based upon the downstream-side driving current Ii that flows through the downstream-side current detection resistor Ri becomes the selection signal Ih/i after the selection.

Upon the injector current Iinj reaching the predetermined peak-hold upper-limit current Ip2, the peak current hold period P2 begins, at which time, the boost driving FET control signal SDh is controlled to repeat on/off states so that the injector current is held to range between the peak hold lower-limit current Ip1 and the peak-hold upper-limit current Ip2. This results in the applied injector voltage Vinj intermittently becoming the boost voltage Vh.

During the peak current hold period P2, the injector current Iinj can be reduced from the peak-hold upper-limit current Ip2 to the peak hold lower-limit current Ip1 by activating both the battery-side driving FET control signal SDb and the injector downstream-side driving FET control signal SDi, as denoted by items (E), (F) in FIG. 2. This, in turn, activates both the battery-side driving FET 212 and the injector downstream-side driving FET 220. Additionally, as denoted by item (D) in FIG. 2, the boost driving FET control signal SDb turns off, which then deactivates the boost driving FET 202 as well. Thus, the applied injector voltage Vinj drops to the battery voltage Vb (in fact, the voltage Vinj suffers a decrease of about 1 [V] due to the boost voltage drop in the diode Dh). A current drop is thus alleviated. This scheme is hereinafter termed the peak-hold assist scheme. The peak-hold assist circuit (PHA) 245A implements the peak-hold assist scheme.

Upon the injector current Iinj reaching the predetermined peak-hold lower-limit current Ip1, the gate logic circuit 245 once again activates the boost driving FET control signal SDh, as denoted by item (D) of FIG. 2, and thus activates the boost driving FET 202. Consequently, the injector current Iinj increases as denoted by item (C) of FIG. 2. The boost driving FET control signal SDh is controlled to repeat on/off alternation so that the injector current is held to range between the peak hold lower-limit current Ip1 and the peak-hold upper-limit current Ip2.

If an average value of the peak hold lower-limit current Ip1 and the peak-hold upper-limit current Ip2 is defined as a peak hold current Ih0, the injector current Iinj during the peak current hold period P2 is held on the average to equal the peak hold current Ih0.

In the above-described peak-hold assist scheme, frequency of shifting the injector current Iinj from the peak hold lower-limit current Ip1 to the peak-hold upper-limit current Ip2 during the peak current hold period P2 by using the booster circuit decreases, which in turn reduces the load of the booster circuit.

The reason why the electromagnetic valve driving circuit according to the present embodiment reduces the frequency of shifting the injector current Iinj from the peak hold lower-limit current Ip1 to the peak-hold upper-limit current Ip2 during the peak current hold period P2 by using the booster circuit is described below using FIGS. 3A to 3C.

Figure 3A:
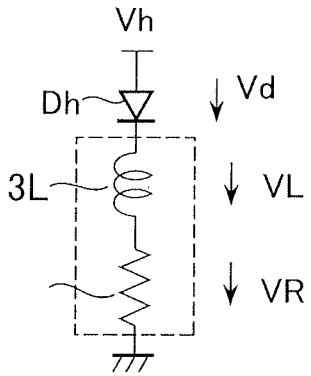
FIGS. 3A to 3C are explanatory diagrams of advantageous effects of the electromagnetic valve driving circuit according to the first embodiment of the present invention.
Figure 3B:
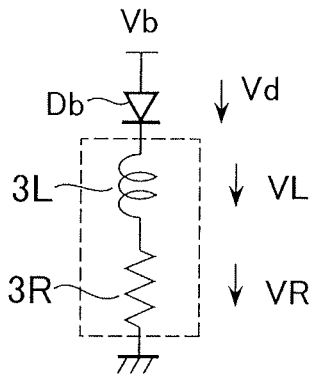
Figure 3C:
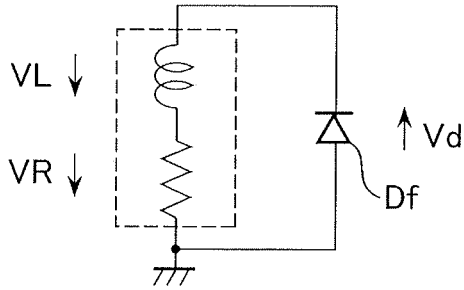

FIGS. 3A to 3C are explanatory diagrams of advantageous effects of the electromagnetic valve driving circuit according to the first embodiment of the present invention.

FIG. 3A shows an equivalent circuit having both the boost driving FET 202 and the injector downstream-side driving FET 220 turned on and the battery-side driving FET 212 turned off. In FIG. 3A, the resistors Rh and Ri shown in FIG. 1 are omitted for simplicity of the description.

In the equivalent circuit, across an internal coil 3L of the injector 3 is developed a voltage of VL=Vh−Vd−VR, where Vh is the boost voltage applied from the booster circuit 100, Vd is the voltage drop in the diode Dh, and VR is a voltage developed across an internal parasitic resistor 3R of the injector 3. The voltage VL across the internal coil 3L of the injector 3 can be expressed as L (di/dt), where L is inductance of the internal coil 3L. A time-variation rate (di/dt) of the current which flows through the internal coil 3L can therefore be expressed as (VL/L)=((Vh−Vd−VR)/L).

Here, let the boost voltage Vh be 65 V, for example. If the internal parasitic resistor 3R of the injector 3 has a resistance of 5 ohms and the peak-hold upper-limit current Ip2 has a value of 6 A, a voltage of 30 V is generated as the voltage VR across the internal parasitic resistor 3R of the injector 3. In addition, let the voltage drop Vd in the diode Dh be 1 V. In this case, the time-variation rate (di/dt) of the current through the internal coil 3L is (34/L).

FIG. 3B shows an equivalent circuit having both the battery-side driving FET 212 and the injector downstream-side driving FET 220 turned on and the boost driving FET 202 turned off. In FIG. 3B, the resistors Rb and Ri shown in FIG. 1 are omitted for the simplicity of the description. The circuit in FIG. 3B is equivalent to an equivalent circuit that suffers an injector current decrease during the peak current hold period P2 in FIG. 1.

The voltage VL across the internal coil 3L of the injector 3 in this case is (Vb−Vd−VR), where Vb is the boost voltage applied from the battery power supply, Vd is a likely voltage drop in the diode Db, and VR is the voltage developed across the internal parasitic resistor 3R of the injector 3. The voltage VL across the internal coil 3L of the injector 3 can be expressed as L (di/dt). A time-variation rate (di/dt) of the current which flows through the internal coil 3L can therefore be expressed as (VL/L)=((Vb−Vd−VR)/L).

Here, let the battery voltage Vb be 12 V, for example. At a point of time when an increase in the injector current ends, that is, under the state shown in FIG. 3A, the voltage VR across the internal parasitic resistor 3R of the injector 3 is 30 V as described above. In addition, let the voltage drop Vd in the diode Dh be 1 V. In this case, the time-variation rate (di/dt) of the current through the internal coil 3L is (−19/L).

FIG. 3C shows for comparison purposes an equivalent circuit used for reducing the injector current in a conventional freewheeling scheme. In this circuit composition, both the battery-side driving FET 212 and the boost driving FET 202 have been deactivated and only the injector downstream-side driving FET 220 is activated to cause a freewheeling current to flow through the diode Df. In FIG. 3C, the resistor Ri shown in FIG. 1 is omitted for the simplicity of the description.

A voltage VL across an internal coil 3L of the injector 3 in this case is ((−Vd)−VR), where Vd is a likely voltage drop in the diode Df and VR is a voltage developed across the internal parasitic resistor 3R of the injector 3. The voltage VL across the internal coil 3L of the injector 3 can be expressed as L (di/dt). A time-variation rate (di/dt) of the current which flows through the internal coil 3L can therefore be expressed as (VL/L)=((−Vb−VR)/L).

Here, for example, at the end of the increase in the injector current, that is, under the state shown in FIG. 3A, the voltage VR across the internal parasitic resistor 3R of the injector 3 is 30 V as described above. In addition, let the voltage drop Vd in the diode Dh be 1 V. In this case, the time-variation rate (di/dt) of the current through the internal coil 3L is (−31/L).

That is to say, in the conventional scheme, the current variation rate di/dt during the increase in the injector current is (34/L) and the current variation rate di/dt during the decrease in the injector current is (−31/L), gradients of both variation rates being substantially of the same magnitude.

As opposed to this, in the scheme of the present embodiment, the current variation rate di/dt during the increase in the injector current is (34/L) and the current variation rate di/dt during the decrease in the injector current is (−19/L). The variation rate during the decrease can therefore be made gentle in gradient.

Consequently, a time needed to increase/reduce the injector current can be extended by at least 30% of that required in the conventional scheme. In the example of FIG. 2, the increase/decrease in the injector current is repeated three times during the peak current hold period P2. During actual operation, however, the peak current hold period P2 is nearly 0.8 ms, for example. During this period, the increase/decrease in the injector current is repeated several tens of times in the conventional scheme. If the increase/decrease in the injector current is repeated several tens of times, therefore, this number of repetition cycles can be made at least 30% smaller, which means that the load of the booster circuit during the peak current hold period P2 can be reduced by at least 30%.

During the peak current hold period P2, the particular parasitic resistance value of the injector to be driven may increase the injector current, instead of reducing this current to the peak hold lower-limit current Ip1, when the peak-hold assist scheme is adopted. In other words, in a case where the voltage drop VR in the parasitic resistor 3R due to the conduction of the peak current, and the applied injector voltage Vinj, are in a relationship of VR>Vinj, the injector current decreases, but in a case where the above relationship is VR<Vinj, the injector current increases. In the latter case, the gate-driving logic circuit 245 deactivates the battery-side driving FET control signal SDb in accordance with the injector downstream-side current detection signal SIi that is based upon the downstream-side driving current Ii flowing through the downstream-side current detection resistor Ri. That is to say, the injector downstream-side current selection signal 245*i* is controlled to be on and the boost current selection signal 245*h* is controlled to be off. The current selection circuit 244 then selects the injector downstream-side current detection signal SIi that is output from the current detection circuit 243. This allows the injector current Iinj to be reduced from the peak hold upper-limit current Ip2 to the peak hold lower-limit current Ip1, even in the conventional freewheeling scheme. Providing this function allows the injector driving circuit of the present embodiment to appropriately drive diverse fuel injectors of the direct in-cylinder injection type.

Next, as denoted by item (B) of FIG. 2, upon the injector valve-opening signal 300*b* changing from the 'on' level to the 'off' level, the open-valve state hold current transition period P3 starts. At this time, as denoted by items (D), (E) and (F) of FIG. 2, the boost driving FET control signal SDh, the battery-side driving FET control signal SDb, and the injector downstream-side driving FET control signal SDi are all controlled to be off. This causes the injector supply current to flow into the booster circuit 100 through the regeneration diode Dr. At this time, the applied injector voltage Vinj decreases below −Vh, so that the current that flows through the injector will abruptly decrease in level. This decrease occurs for purposes such as improving independent characteristics of the injector and improving combustion characteristics of the fuel.

The boost driving FET 202 and the injector downstream-side driving FET 220 are both deactivated during the open-valve state hold current transition period P3. This conducts no current to the downstream-side current detection resistor Ri, thus making the resistor Ri unuseable to detect the injector current Iinj. In this case, the current detection circuit 241 can instead detect the current Ih that flows into the boost current detection resistor Rh through the current regeneration diode Dr. More specifically, when the injector downstream-side current selection signal 245*i* is controlled to be off and the boost current selection signal 245*h* is controlled to be on, the current selection circuit 244 selects the boost current detection signal SIh that is output from the current detection circuit 241.

Next, as denoted by item (C) of FIG. 2, upon the injector current Iinj reaching the open-valve state hold lower-limit current If1, the open-valve state hold current conduction period P4 starts, in which period, as denoted by items (D), (E) and (F) of FIG. 2, the boost driving FET control signal SDh is controlled to be off, the injector downstream-side driving FET control signal SDi is controlled to be on. and the battery-side driving FET control signal SDb is controlled to alternate between the 'on' and 'off' states. That is to say, when the injector current Iinj reaches the open-valve state hold upper-limit current If2, the battery-side driving FET control signal SDb is controlled to be off and the injector supply current decreases in level while freewheeling along the route that passes through the freewheeling diode Df. Conversely, when the injector current Iinj reaches the open-valve state hold lower-limit current (current If1), the battery-side driving FET control signal SDb is controlled to be on and the injector current Iinj rises to the open-valve state hold upper-limit current If2. In this form, the battery-side driving FET control signal SDb repeats on/off switching control, so the injector current level during this period is held to stay between the open-valve state hold upper-limit current If2 and the open-valve state hold lower-limit current If1. At this time, the injector downstream-side current selection signal 245*i* is controlled to be on, the boost current selection signal 245*h* is controlled to be off, and the current selection circuit 244 selects the injector downstream-side current detection signal SIi that is output from the current detection circuit 243.

Accordingly, when an average value of the open-valve state hold upper-limit current If2 and the open-valve state hold lower-limit current If1 is defined as an open-valve state hold current If0, the injector current Iinj during the open-valve state hold current conduction period P4 is held on the average to equal an open-valve state hold current If. With the open-valve state hold current, open-valve state is held without supplying current increased in level.

Upon the injector driving signal 300*c* changing from 'on' to 'off' as denoted by item (A) of FIG. 2, the supply current reduction period P5 starts. During this period, as denoted by items (D), (E) and (F) of FIG. 2, the boost driving FET control signal SDh, the battery-side driving FET control signal SDb, and the injector downstream-side driving FET control signal SDi are all controlled to be off. This causes the injector supply current to flow into the booster circuit 100 through the regeneration diode Dr, and thus the injector current level to abruptly decrease. At this time, the injector downstream-side current selection signal 245*i* is controlled to be off and the boost current selection signal 245*h* is controlled to be on, so that the current selection circuit 244 selects the boost current detection signal SIh that is output from the current detection circuit 241.

Next, the snubber circuit connected in parallel to the battery protection diode Db is described below. The snubber circuit is a series circuit composed of a resistor Rs and a capacitor Cs. In snubber circuits, controlling the battery-side driving FET control signal SDb to be on during the peak current hold period P2 might cause noise due to a recovery current of the battery protection diode Db, since current flows through the diode during the period P2. This noise can however be suppressed by providing a series-connected resistor and capacitor in the snubber circuit connected in parallel to the battery protection diode Db.

It has been described above that during the peak current hold period P2, the injector current Iinj starts dropping after reaching the peak hold upper-limit current level Ip2, and restarts rising after dropping to the peak hold lower-limit current level Ip1. Instead, however, the injector current level may be increased after a predetermined time following the start of the drop after the arrival at the peak hold upper-limit current level Ip2.

It has also been described above that the peak hold current Ih0 is held at a constant level during the peak current hold period P2. Instead, however, the peak hold upper-limit current level Ip2 and the peak hold lower-limit current level Ip1 may be set to gradually increase for a progressive increase in the peak hold current level Ih0.

Alternatively, the peak hold upper-limit current level Ip2 and the peak hold lower-limit current level Ip1 may be set to gradually decrease for a progressive decrease in the peak hold current level Ih0.

Another possible alternative may be to supply the battery voltage to the injector during a drop of the injector current in a part of the peak current hold period P2.

As described above, according to the present embodiment, a current drop can be made more gentle than in the conventional freewheeling scheme, by adopting the peak-hold assist scheme that activates both the battery-side driving FET control signal SDb and the injector downstream-side driving FET control signal SDi when dropping the injector current from the peak hold upper-limit current level Ip2 to the peak hold lower-limit current level Ip1 during the peak current hold period P2. The frequency of shifting the injector current Iinj from the peak hold lower-limit current Ip1 to the peak-hold upper-limit current Ip2 during the predetermined peak current hold period P2 by using the booster circuit decreases as a result. This decrease reduces a charge removed from the boost capacitor holding the boost voltage during the peak current hold period P2, and thus results in a reduced boost recovery time and hence a reduced booster circuit load.

Next, a composition and operation of an electromagnetic valve driving circuit according to a second embodiment of the present invention will be described using FIGS. 1 and 4.

A configuration of an electromagnetic valve control system using the electromagnetic valve driving circuit according to the present embodiment is substantially the same as the system configuration of FIG. 1, except in details of the control operation during the open-valve state hold current transition period P3. The details of the control operation are described below using FIG. 4.

Figure 4:
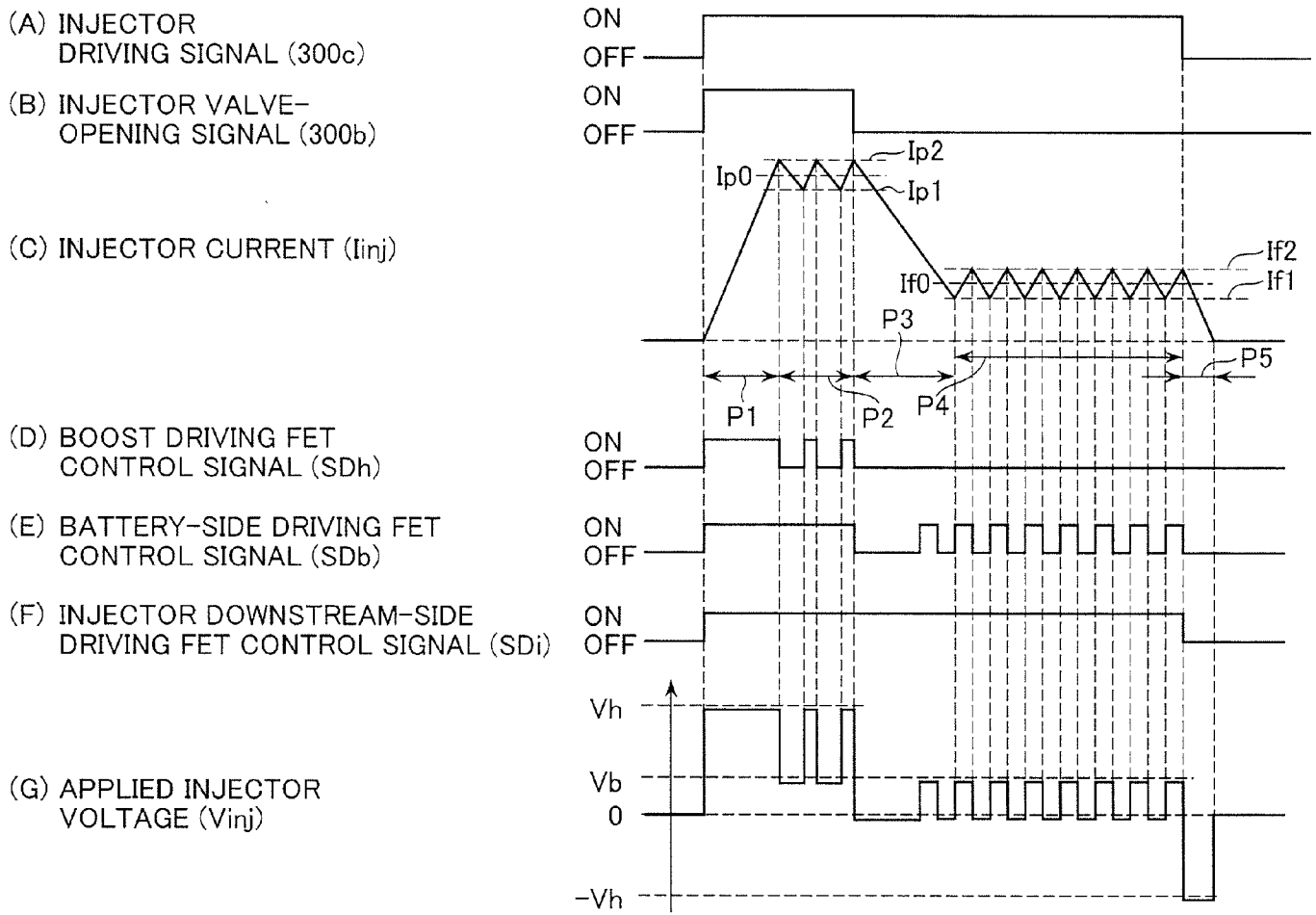
FIG. 4 is a timing chart that illustrates operation of an electromagnetic valve control system using an electromagnetic valve driving circuit according to a second embodiment of the present invention.

FIG. 4 is a timing chart that illustrates operation of the electromagnetic valve control system using the electromagnetic valve driving circuit according to the second embodiment of the present invention.

A horizontal axis in FIG. 4 denotes time. Vertical axes in items (A) to (G) of FIG. 4 denote the same as that of items (A) to (G) of FIG. 2.

As denoted by item (B) of FIG. 4, upon the injector valve-opening signal 300*b* changing from 'on' to 'off', the open-valve state hold current conduction period P3 starts, in which period, as denoted by items (D) and (E) of FIG. 4, the boost driving FET control signal SDh and the battery-side driving FET control signal SDb are controlled to be off. Meanwhile, as denoted by item (F) of FIG. 4, the injector downstream-side driving FET control signal SDi is controlled to be on. This is where the present embodiment differs from the first embodiment. The results are that the injector supply current freewheels through the freewheeling diode Df, and thus that a decrease rate of the injector current during this period is controlled to a level lower than that achieved in the first embodiment. This decrease occurs for purposes such as improving the independent characteristics of the injector and improving the combustion characteristics of the fuel.

During the open-valve state hold current conduction period P3, the injector downstream-side current selection signal 245*i* is controlled to be on, and the boost current selection signal 245*h* is controlled to be off. This makes the current selection circuit 244 select the injector downstream-side current detection signal SIi that is output from the current detection circuit 243. Therefore, the injector downstream-side current detection signal SIi that is based upon the downstream-side driving current Ii that flows through the downstream-side current detection resistor Ri becomes a selection signal Ih/i after the selection.

As described above, according to the present embodiment, the frequency of shifting the injector current from the peak hold lower-limit current Ip1 to the peak-hold upper-limit current Ip2 decreases, which results in reduced booster circuit load.

In addition, the independent characteristics of the injector improve and thus the combustion characteristics of the fuel improve.

Next, a composition and operation of an electromagnetic valve driving circuit according to a third embodiment of the present invention will be described using FIGS. 1 and 5.

A configuration of an electromagnetic valve control system using the electromagnetic valve driving circuit according to the present embodiment is substantially the same as the system configuration of FIG. 1, except in details of the control operation during the open-valve state hold current transition period P3. The details of the control operation are described below using FIG. 5.

Figure 5:
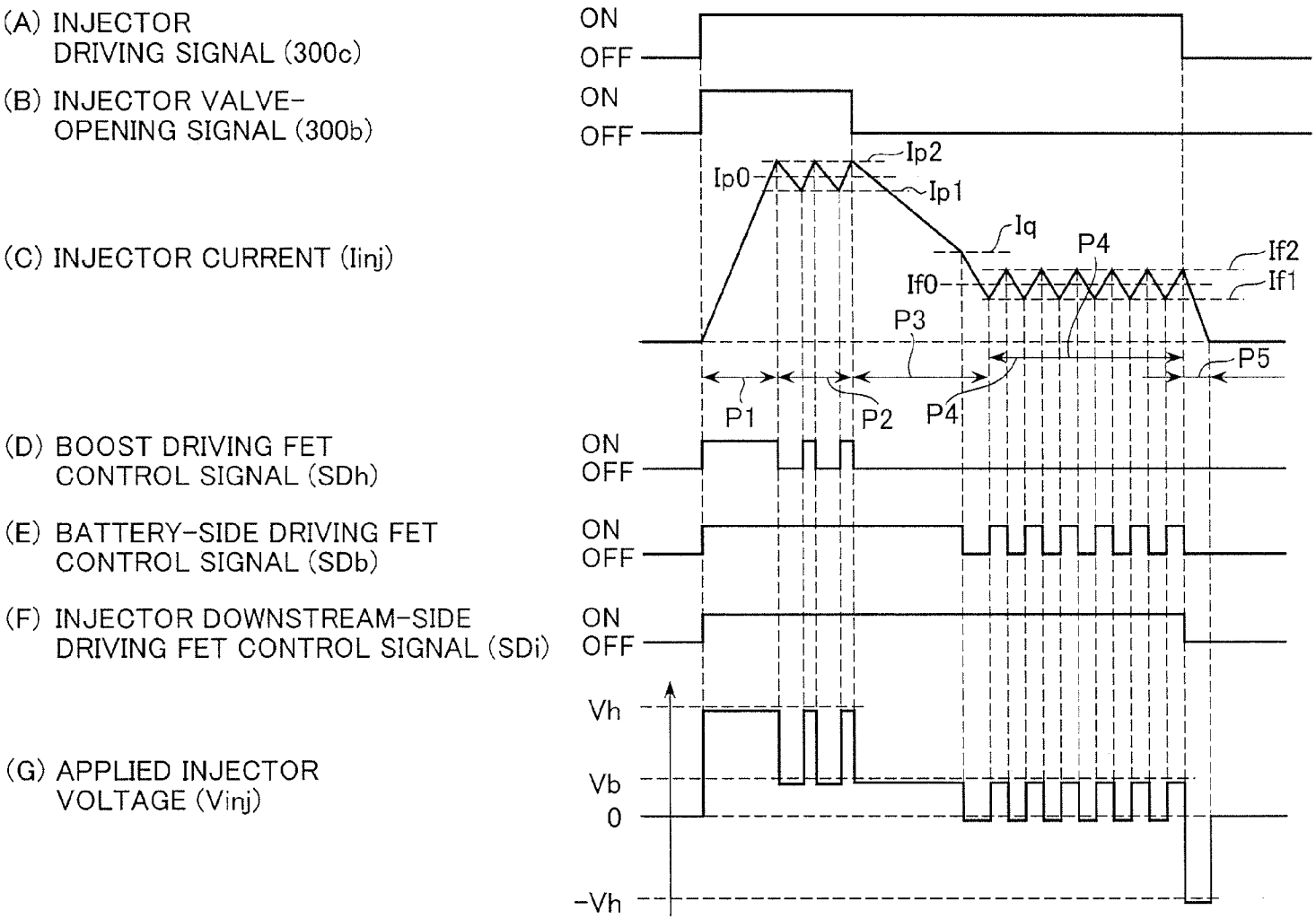
FIG. 5 is a timing chart that illustrates operation of an electromagnetic valve control system using an electromagnetic valve driving circuit according to a third embodiment of the present invention.

FIG. 5 is a timing chart that illustrates operation of the electromagnetic valve control system using the electromagnetic valve driving circuit according to the third embodiment of the present invention.

A horizontal axis in FIG. 5 denotes time. Vertical axes in items (A) to (G) of FIG. 5 denote the same as that of items (A) to (G) of FIG. 2.

As denoted by item (B) of FIG. 5, upon the injector valve-opening signal 300*b* changing from 'on' to 'off', the open-valve state hold current conduction period P3 starts, at which time, as denoted by item (D) of FIG. 5, the boost driving FET control signal SDh is controlled to be off. Meanwhile, as denoted by items (E) and (F) of FIG. 5, the battery-side driving FET control signal SDb and the injector downstream-side driving FET control signal SDi are controlled to be on. This is where the present embodiment differs from the first embodiment. The results are that the applied injector voltage Vinj becomes the battery voltage Vb, and thus that the injector supply current level drops more gently than in the first and second embodiments.

During the above control, however, since the battery voltage is supplied to the injector, the current cannot be dropped to the open-valve state hold lower-limit current level If1. For this reason, the control is shifted to the freewheeling scheme immediately after the injector current detected by the injector downstream-side current detection resistor Ri has dropped to a Vb assist stopping current level 522 higher than the open-valve state hold upper-limit current level If2. That is to say, when the battery-side driving FET control signal SDb changes to 'off', the injector supply current freewheels along the route that passes through the freewheeling diode Df. The injector current thus drops to the open-valve state hold lower-limit current level If1.

For these reasons, in the present embodiment, the open-valve state hold current conduction period P3 is made longer than in the first and second embodiments. The extension of the period P3 occurs for purposes such as improving the independent characteristics of the injector and improving the combustion characteristics of the fuel.

During the open-valve state hold current conduction period P3, the injector downstream-side current selection signal 245*i* is controlled to be on, and the boost current selection signal 245*h* is controlled to be off. This makes the current selection circuit 244 select the injector downstream-side current detection signal SIi that is output from the current detection circuit 243. Therefore, the injector downstream-side current detection signal SIi that is based upon the downstream-side driving current Ii that flows through the downstream-side current detection resistor Ri becomes a selection signal Ih/i after the selection.

As described above, according to the present embodiment, the frequency of shifting the injector current from the peak hold lower-limit current Ip1 to the peak-hold upper-limit current Ip2 decreases, which results in reduced booster circuit load.

In addition, the independent characteristics of the injector improve and thus the combustion characteristics of the fuel improve.

As set forth above, the present invention drives electromagnetic valves using a high voltage obtained by boosting a battery voltage in the automobiles, motorcycles, agricultural tractors, machine tools, or marine engines which are fueled by gasoline, a light oil, or the like. More particularly, the invention relates to an injector driving circuit suitable for driving a fuel injector of a direct in-cylinder injection type.

The present invention is not limited to the above embodiments and can incorporate various changes and modifications that fall within the scope based upon the description of WHAT IS CLAIMED IS:.

In addition, the present invention can be applied to direct in-cylinder fuel injectors powered from a piezoelectric element, as well as those powered from a solenoid.

Furthermore, application of the present invention to an electromagnetic valve driving circuit that uses a supply voltage and a boost voltage can be easily achieved without changing a basic circuit composition.

Reduction in boost recovery time, reduction in the amount of heat occurring in booster circuit elements, reduction in dimensions and costs of booster circuit components, extension of a boost voltage hold capacitor life, reduction in costs of other heat-releasing members, and the like can be provided in the present invention.

What is claimed is:

1. An electromagnetic valve driving circuit, comprising:

a booster circuit for generating a high voltage from a power supply;

a first switching element connected to a route formed between the booster circuit and a first terminal of an electromagnetic valve;

a second switching element connected to a positive-polarity side of the power supply;

a first diode connected to a route formed between a negative-polarity side of the second switching element and the first terminal of the electromagnetic valve;

a second diode with a first terminal connected to a portion between the first terminal of the electromagnetic valve and the first diode, and a second terminal connected to an electrical grounding side of the power supply;

a third switching element connected to a route formed between a second terminal of the electromagnetic valve and the grounding side of the power supply; and control means for operating appropriately the first switching element, the second switching element, and the third switching element, according to a level of a current which flows through the electromagnetic valve;

wherein the control means includes peak-hold assist means for activating the second switching element during a period in which the first switching means repeats on/off switching control a plurality of times;

wherein, by activating/deactivating the first switching element, the control means holds the current that flows through the electromagnetic valve to a first current level; and wherein, during a period of holding the current, which energizes the electromagnetic valve, to the first current level, when the current through the electromagnetic valve increases in level while the control means is deactivating the first switching element and activating the second switching element, the control means re-deactivates the second switching element.

2. The electromagnetic valve driving circuit according to claim 1, wherein:

by deactivating the first switching element and activating/deactivating the second switching element, the control means holds the current that energizes the electromagnetic valve to a second current level lower than the first current level.

3. The electromagnetic valve driving circuit according to claim 2, wherein:

during a period in which the current that energizes the electromagnetic valve shifts from the first current level to the second current level, the control means applies a voltage of the power supply to the electromagnetic valve by deactivating the first switching element and activating the second and third switching elements; and when the current that energizes the electromagnetic valve reaches a third current level lower than the first current level and higher than the second current level, the control means deactivates the second switching element.

4. The electromagnetic valve driving circuit according to claim 2, wherein:

during a period in which the current that energizes the electromagnetic valve shifts from the first current level to the second current level, the control means deactivates the first and second switching elements and activates the third switching element to make the current that flows through the electromagnetic valve circulate via the second diode.

5. The electromagnetic valve driving circuit according to claim 1, further comprising:

a series circuit of a resistor and capacitor, which are connected in parallel to the first diode.

6. The electromagnetic valve driving circuit according to claim 1, further comprising:

a third diode with a first terminal connected to a route formed between the booster circuit and the first switching element, and a second terminal connected to a route formed between the second terminal of the electromagnetic valve and a positive-polarity side of the third switching element;

wherein, during a period in which the current that flows through the electromagnetic valve shifts from the first current level to the second current level, and before stopping the flow of the supply current of the electromagnetic valve, the control means deactivates the first switching element, the second switching element, and the third switching element to make the current that flows through the electromagnetic valve be stored into the booster circuit via the third diode.

* * * * *